US009746146B2

(12) United States Patent
Kaplan et al.

(10) Patent No.: US 9,746,146 B2
(45) Date of Patent: Aug. 29, 2017

(54) ADJUSTABLE LIGHT FIXTURE

(71) Applicant: GENERATION BRANDS LLC, Skokie, IL (US)

(72) Inventors: David Kaplan, Chicago, IL (US); Thomas Michael Sargeant, Oswego, IL (US); Joshua Adam Weiss, Chicago, IL (US); Kevin Michael Fagan, Oak Park, IL (US); Tomas Matusaitis, Chicago, IL (US); Antonio Belton, Richton Park, IL (US); Stephen McPhilliamy, Chicago, IL (US)

(73) Assignee: GENERATION BRANDS LLC

( * ) Notice: Subject to any disclaimer, the term of this patent is extended or adjusted under 35 U.S.C. 154(b) by 13 days.

(21) Appl. No.: 14/267,328

(22) Filed: May 1, 2014

(65) Prior Publication Data

US 2015/0316241 A1 Nov. 5, 2015

(51) Int. Cl.

| | |
|---|---|
| ***F21V 21/26*** | (2006.01) |
| ***F21S 8/04*** | (2006.01) |
| ***F21V 21/30*** | (2006.01) |
| *F21Y 105/00* | (2016.01) |

(52) U.S. Cl.

CPC ..... *F21S 8/04* (2013.01); *F21V 21/30* (2013.01); *F21V 21/26* (2013.01); *F21Y 2105/00* (2013.01); *Y10T 29/49828* (2015.01)

(58) Field of Classification Search

CPC ..... F21V 21/26; F21V 21/28; F21V 21/29; F21V 21/34; F21V 21/30; F21S 8/04

See application file for complete search history.

(56) References Cited

U.S. PATENT DOCUMENTS

| | | | | |
|---|---|---|---|---|
| 3,882,306 | A * | 5/1975 | Armstrong | F21V 21/30 362/427 |
| 4,779,178 | A * | 10/1988 | Spitz | F21S 8/06 362/220 |
| 4,802,065 | A * | 1/1989 | Minter | F21S 8/028 362/147 |
| 6,450,668 | B1 * | 9/2002 | Kotloff | F21S 8/06 362/221 |
| 6,517,216 | B1 * | 2/2003 | Cercone | F21S 8/026 362/220 |
| 7,306,359 | B2 * | 12/2007 | Harwood | F21S 2/005 362/382 |
| 7,600,907 | B2 * | 10/2009 | Liu | F21V 19/001 362/249.03 |
| 2003/0123252 | A1 * | 7/2003 | Cercone | F21S 8/026 362/147 |
| 2007/0163170 | A1 * | 7/2007 | Brault | A01G 7/045 47/17 |

(Continued)

*Primary Examiner* — Anh Mai
*Assistant Examiner* — Zachary J Snyder
(74) *Attorney, Agent, or Firm* — Marshall, Gerstein & Borun LLP; Randall G. Rueth

(57) ABSTRACT

An adjustable light fixture including a base and a mounting member configured to movably connect a light source to the base. The mounting member is configured to rotate about a rotational axis that moves relative to the base. The adjustably light fixture can be implemented as an overhead light fixture by connecting the base to a ceiling. Also provided is a method adjusting an overhead light fixture including rotating a mounting member and translating the mounting member relative to a base.

20 Claims, 7 Drawing Sheets

(56) References Cited

U.S. PATENT DOCUMENTS

| | | | | |
|---|---|---|---|---|
| 2009/0201681 | A1* | 8/2009 | Galke | F21S 2/00 362/249.07 |
| 2009/0251905 | A1* | 10/2009 | Melzner | F21V 21/15 362/418 |
| 2010/0097795 | A1* | 4/2010 | Chiang | F21S 2/00 362/232 |

* cited by examiner

ADJUSTABLE LIGHT FIXTURE

TECHNICAL FIELD

The present disclosure relates to an adjustable light fixture and, more particularly, to an adjustable light fixture including a mounting member that movably connects a light source to a base.

BACKGROUND

Overhead lighting is commonly provided by a light fixture that directs light in the downward direction. It is sometimes desirable to adjust the direction of the light so that objects which are not located directly beneath the light fixture are better illuminated. For instance, a store owner may wish to adjust an overhead light fixture to direct light at products arranged on a wall shelf.

One way to adjust the direction of the light is to mount the light source on a rotating structure as shown in FIG. 1. The light fixture 100 illustrated in FIG. 1 includes a base 110, a mounting member 120 rotatably connected to the base 110, and a light source 130 carried by the mounting member 120. The mounting member 120 rotates about its central longitudinal axis. As a result, a portion of the mounting member 120 protrudes above the upper plane of the light fixture 100 when the light source 130 is arranged to direct light in an angled direction. It may be necessary to suspend the light fixture 100 from the ceiling so that there is clearance between the light fixture 100 and the ceiling for the mounting member 120 to rotate. While it is possible to arrange the light fixture 100 in a recess in the ceiling so that the mounting member 120 has room to rotate, this may result in light clipping due to a portion of the light source 130 being positioned above the ceiling when the mounting member 120 is rotated.

FIG. 2 illustrates a light fixture 200 including a mounting member 220 with one end rotatably connected to a base 210. A light source 230 is carried by the mounting member 220 and swings below the base 210 when the mounting member 220 rotates. While the mounting member 220 does not interfere with the ceiling during rotation, the mounting member 220 tends to shift the center of gravity of the light fixture as the mounting member 220 rotates. This impacts the stability of the light fixture 200 and may cause the light fixture 200 to become tilted, particularly when the light fixture 200 is suspended from the ceiling by cords.

SUMMARY

Disclosed herein is an adjustable light fixture including a base, a first slot, a second slot and a mounting member. The base includes a cavity bounded on opposite sides by a first end plate and a second end plate. The first slot extends through the first end plate, and the second slot extends through the second end plate. The mounting member is configured to movably connect a light source to the base. The mounting member includes a first projection slidably disposed in the first slot and a second projection slidably disposed in the second slot. The mounting member is rotatable about a rotational axis that moves relative to these base when the first and second projections slide along their respective first and second slots.

Also disclosed is an overhead adjustable light fixture that includes a base and a mounting member configured to movably connect a light source to the base. The base is attachable to an overhead static structure. The mounting member is rotatable about a rotational axis. The rotational axis is movable relative to the base.

Further disclosed is a method of adjusting an overhead light fixture including a base attached to a ceiling, a light source and a mounting member movably connecting the base and the light source. The method includes rotating the mounting member about a rotational axis, and translating the mounting member relative to the base so that the rotational axis translates relative to the base.

DETAILED DESCRIPTION

Although the following text sets forth a detailed description of numerous different embodiments, the claims set forth at the end of this application are not limited to the disclosed embodiments. The detailed description is to be construed as exemplary only and does not describe every possible embodiment of the invention since describing every possible embodiment is impractical. Numerous alternative embodiments can be implemented, using either current technology or technology developed after the filing date of this application, which would still fall within the scope of the claims.

Figure 1:
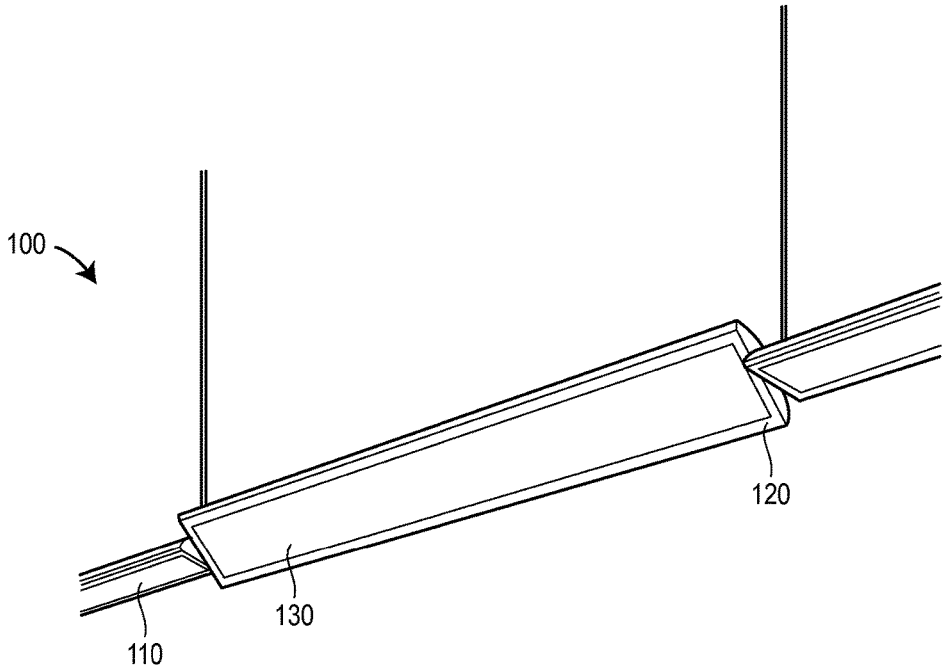
FIG. 1 PRIOR ART
FIG. 1 depicts a perspective view of a known adjustable light fixture.
Figure 2:
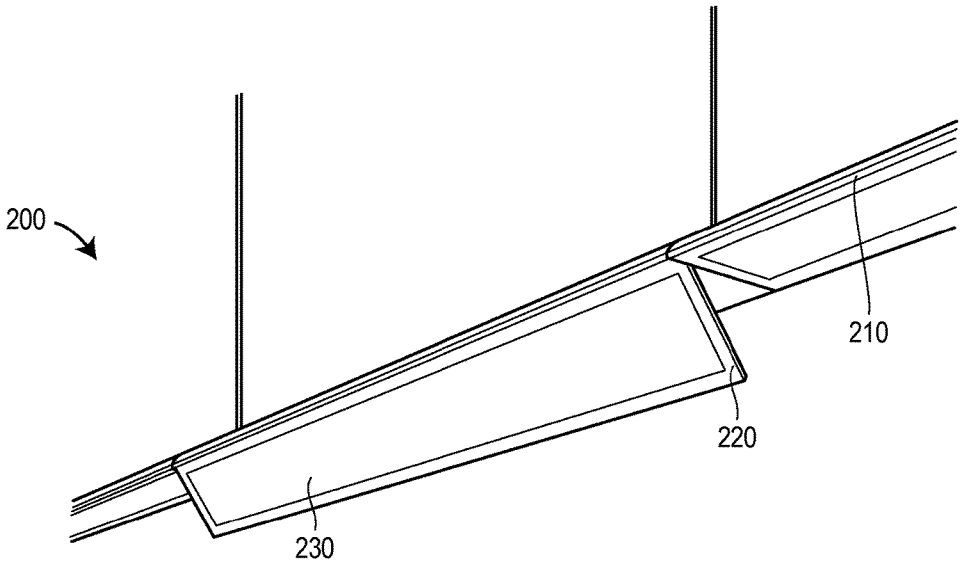
FIG. 2 PRIOR ART
FIG. 2 illustrates a perspective view of another known adjustable light fixture.
Figure 3A:
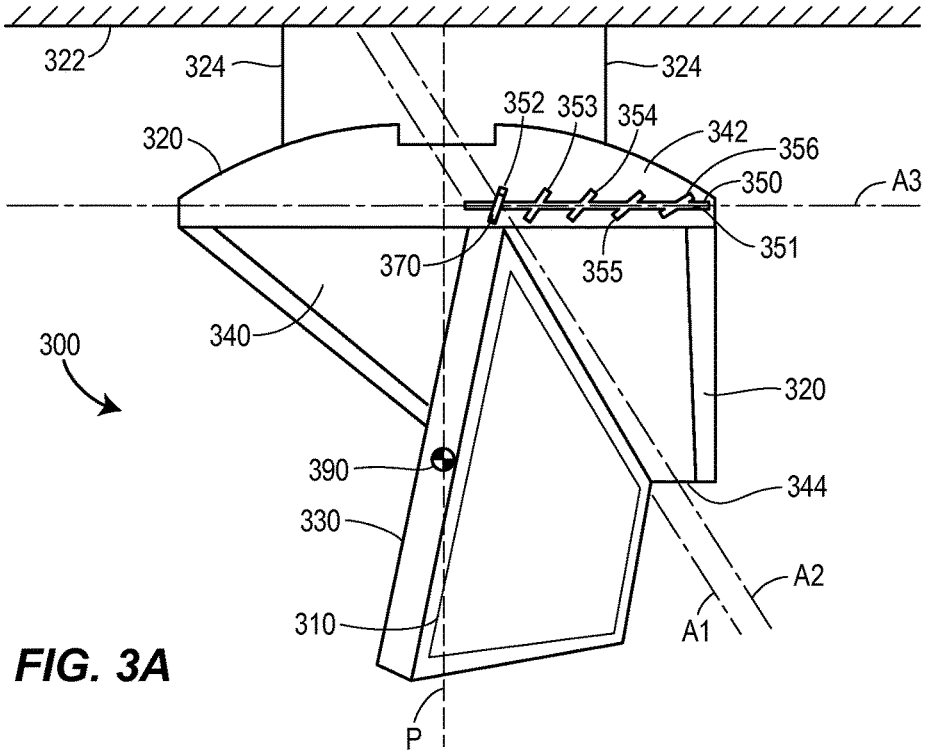
FIGS. 3A and 3B are perspective views of an adjustable light fixture constructed in accordance with principles of a first example of the present disclosure.
Figure 3B:
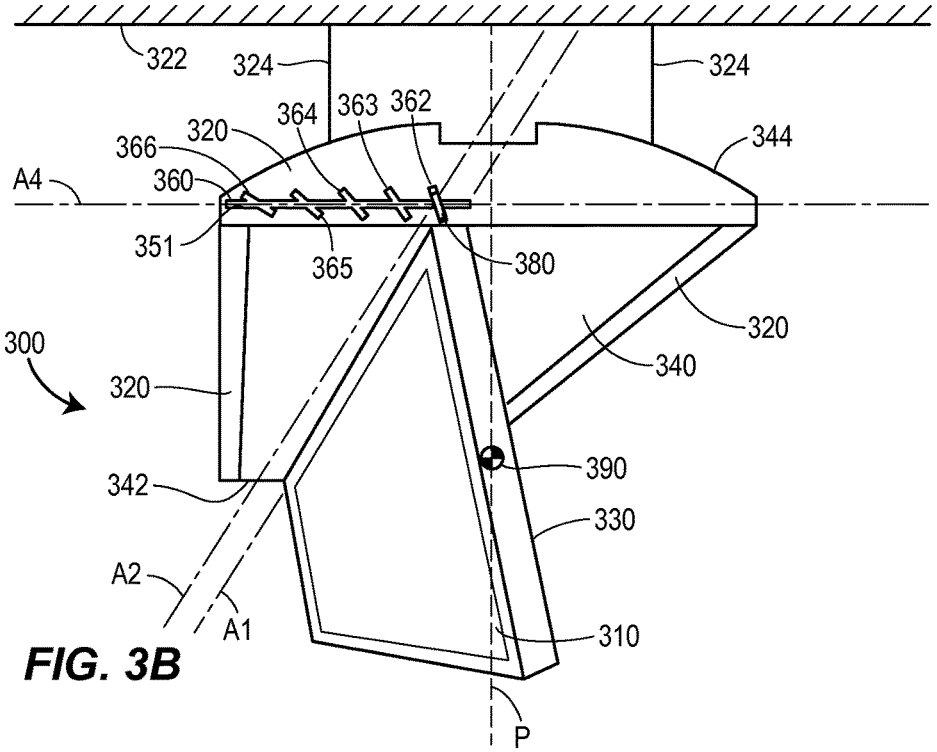

FIG. 3A is a perspective view of one embodiment of an adjustable light fixture 300 which can be used to change the direction of light emitted by a light source 310. The light fixture 300 includes a base 320 and a mounting member 330. The mounting member 330 movably connects the light source 310 to the base 320. The base 320 extends along a longitudinal axis A1 and includes a cavity 340 bounded on opposite sides by a first end plate 342 and a second end plate 344. A frontal view of the second end plate 344 is shown in FIG. 3B. A first slot 350 extends through the first end plate 342, and a second slot 360 extends through the second end plate 344. The mounting member 330 includes a first projection 370 slidably disposed in the first slot 350 and a second projection 380 slidably disposed in the second slot 360.

Generally, during operation of the adjustable light fixture 300, the mounting member 330 rotates about a rotational axis A2, and the first and second projections 370, 380 slide along their respective first and second slots 350, 360. The rotational axis A2 moves relative to the base 320 as a result of the sliding movement of the first and second projections 370, 380. The rotation of the mounting member 330 and the sliding movement of the first and second projections 370, 380 may occur simultaneously, or at different times. The combination of rotational and translational movement of the mounting member 330 enables a center of gravity 390 of the mounting 330 to move along a path P orthogonal or substantially orthogonal to the longitudinal axis A1 of the base 320.

Each of the foregoing components of the adjustable light fixture 300 and the methods of operating the adjustable light fixture 300 are now be described in more detail.

Referring still to FIGS. 3A and 3B, the base 320 of the adjustable light fixture 300 is attached to a static structure 322. The static structure 322 may be an overhead structure such as a ceiling. The base 320 illustrated in FIGS. 3A and 3B is suspended from the static structure 322 by cords 324. In some embodiments, the base 320 is fastened directly to the static structure such that there is little or no gap between the base 320 and the static structure 322. The static structure 322 may have a recessed portion or cavity, and the base 320 may be positioned in the recessed portion or cavity such that the bottom of the base 320 is flush with the static structure 322. The base 320 can be made of any suitably rigid material including plastic, metal and the like.

The first and second end plates 342, 344 may be formed unitarily, in one-piece, with the remainder of the base 320. The first and second end plates 342, 344 can also be formed separately from the rest of the base 320. Cover plates (not shown) may cover the outwardly facing surfaces of the first and second end plates 342, 344 to hide the first and second slots 350, 360 from view.

The first and second slots 350, 360 illustrated in FIGS. 3A and 3B extend through their respective first and second end plates 342, 344 and thus form through holes. In one embodiment, the first and second slots 350, 360 do not extend through the first and second end plates 342, 344 and instead form respective blind holes in the inwardly facing surfaces of the first and second end plates 342, 344. This configuration of the first and second slots 350, 360 may be employed to hide the first and second slots 350, 360 from view.

The first slot 350 guides the first projection 370 of the mounting member 330 along an axis A3. The first slot 350 includes an interior surface 351 that surrounds the first slot 350. The interior surface 351 includes a plurality of spaced apart recessed portions or grooves 352, 353, 354, 355 and 356. Each of the grooves 352-356 is dimensioned to receive the first projection 370 in a lockable manner. Insertion of the first projection 370 into one of the grooves 352-356 prevents movement of the first projection 370 along the axis A3. Each of the grooves 352-256 is angled in a different manner with respect to the axis A3. The innermost groove 352, positioned closest to the center of the base 320, is angled to a larger extent than the other grooves. Moving outwardly from the groove 352, the grooves 353-356 possess progressively smaller angles so that the outermost groove 356 has the smallest angle. In one embodiment, the groove 352 is orthogonal to the axis A3 and overlaps a centerline of the base 320. In one embodiment, the grooves 352-356 are angled at increments of 10 degrees. The number of grooves is not limited to that shown in FIG. 3A.

The second slot 360 guides the second projection 380 along an axis A4. The axis A4 may be parallel to the axis A3. An interior surface 361 surrounds the second slot 360 and includes a plurality of spaced apart recessed portions or grooves 362, 363, 364, 365 and 366. Each of the grooves 362-366 is dimensioned to receive the second projection 380 in a lockable manner. Movement of the second projection 380 along the axis A4 is prevented when the second projection 380 is aligned with one of the groves 362-366. Each of the grooves 362-366 is angled in a different manner relative to the axis A4. The innermost groove 362 is angled to a larger extent than the other grooves. Moving outwardly from the groove 362, the grooves 363-366 have progressively smaller angles so that the outermost groove 366 possesses the smallest angle. In one embodiment, the groove 362 is orthogonal to the axis A4 and overlaps a centerline of the base 320. The grooves 362-366 may be angled at increments of 10 degrees. The number of grooves may be greater than or less than that shown in FIG. 3B. Each of the grooves of the second slot 360 may correspond to one of the grooves of the first slot 350 such that each groove of the second slot 360 and its counterpart groove in the first slot 350 possess the same angle. For instance, the groove 362 and the groove 352 may possess the same angle.

The light source 310 is mounted on the mounting member 330 and connected to an electric power supply (not shown). In one embodiment, the light source 310 is removably attached to the mounting member 330 so that the light source 310 can be replaced in the event of malfunction. The light source 310 generally emits light in the rightward direction in FIG. 3A and the leftward direction in FIG. 3B. The light source 310 is any device capable of converting electricity into electromagnetic energy including, but not limited to, a light emitting diode (LED), a fluorescent light bulb, an incandescent light bulb, a halogen light bulb, etc. In one embodiment, the light source 310 is an LED panel. The LED panel may provide directional lighting by emitting light in a direction generally orthogonal to the outwardly facing surface of the LED panel.

The mounting member 330 is movably connected to the base 320 by virtue of the first and second projections 370, 380. In one embodiment, the first and second projections 370, 380 extend from the sides of the mounting member 330 in a direction substantially parallel or parallel to the longitudinal axis A1 of the base 320. The mounting member 330 may carry the electrical connections needed to connect the light source 310 to the electric power supply. The mounting member 330 is configured to rotate about the rotational axis A2 so that the mounting member 330 can swing below the base 320. The rotational axis A2 may pass through the first and second projections 370, 380. The rotational axis A2 moves as the first and second projections 370, 380 slide through their respective first and second slots 350, 360. In one embodiment, the mounting member 330 is configured to clamp the light source 310 between arms that extend along the length of the mounting member 330. The outer perimeter of the mounting member 330 may surround the light source 330, and may possess a substantially rectangular shape. The center of gravity 390 of the mounting member 330 is located near the center of the mounting member 330. The position of the center of gravity 390 may be unaffected by the addition of the light source 310 to the mounting member 330. The mounting member 330 may be formed of metal, plastic or any other suitably rigid material.

The operation of the adjustable light fixture 300 will now be described with reference to FIGS. 4A-4C. These figures depict a cross-section of the adjustable light fixture 300 near the middle of the adjustable light fixture 300. The first and second slots 350, 360 and the first and second projections 370, 380 are depicted with broken lines in FIGS. 4A-4C because the cross-section does not actually pass through these elements.

Figure 4A:
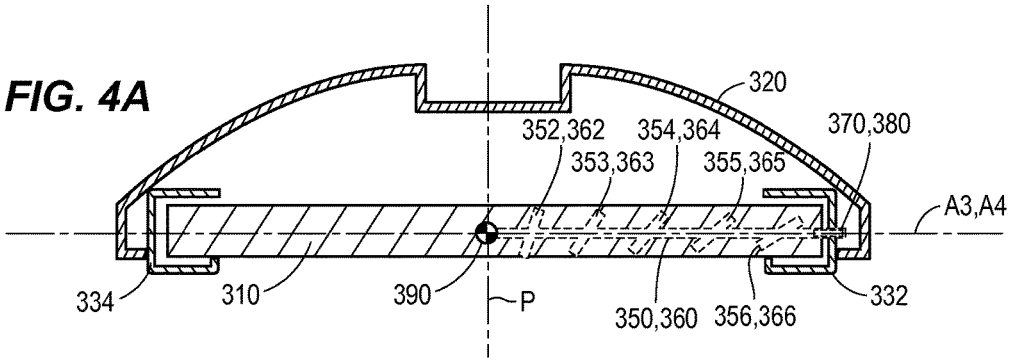
FIG. 4A is cross-sectional view of the adjustable light fixture in a retracted position.

FIG. 4A depicts the mounting member 330 in a retracted position. Here, first and second ends 332, 334 of the mounting member 330 are housed in the cavity 340 of the base 320. The light source 310 is also positioned within the cavity 340. FIG. 4A shows that a portion of the mounting member 330 and the light source 310 protrude from the cavity 340 in the retracted position. In one embodiment, the bottom of the mounting member 330 and/or the bottom of the light source 310 is flush with the bottom of the base 320. In the retracted position, the light source 310 is oriented to emit light generally in the downward direction away from the ceiling.

Figure 4B:
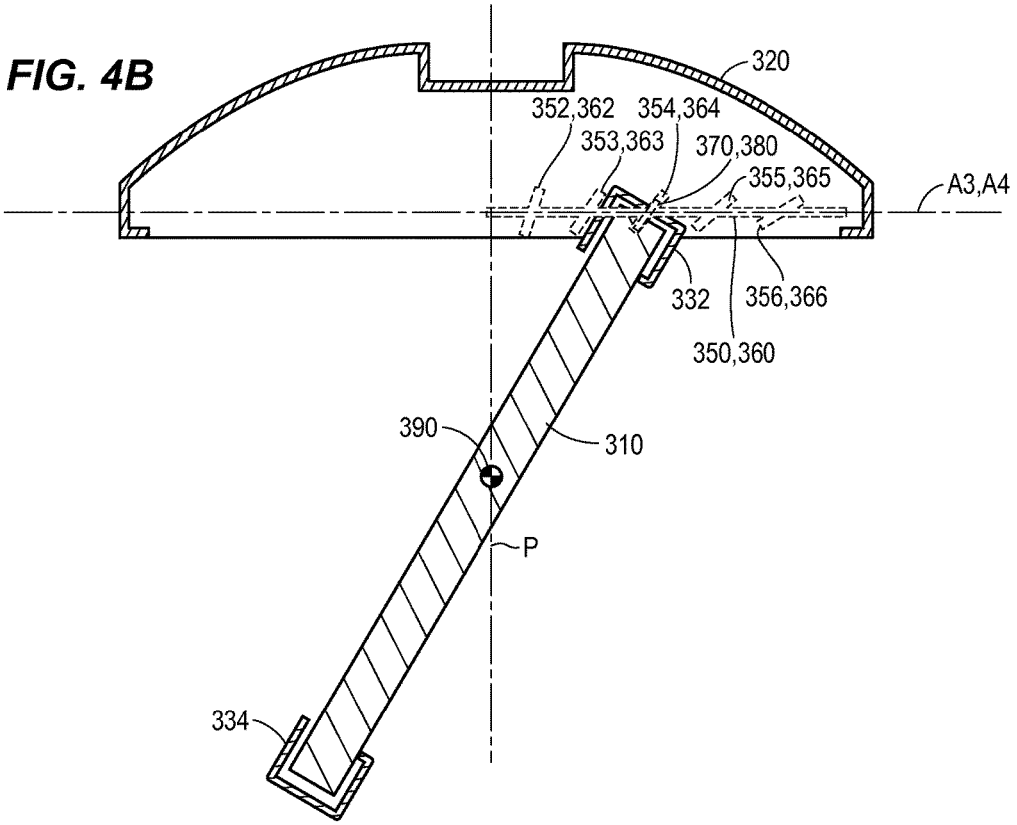
FIG. 4B depicts a cross-sectional view of the adjustable light fixture in an extended position.

FIG. 4B depicts the mounting member 330 in an extended position enabling the light source 310 to emit light in an angled direction. The mounting member 330 is moved into the extended position by rotating the mounting member 330 counterclockwise about the rotational axis A2 so that the second end 334 of the mounting member 330 swings below the base 320. Additionally, the first end 332 of the mounting member 330 is translated along the axes A3, A4 so that the rotational axis A2 moves relative base 320. This involves moving the first and second projections 370, 380 along their respective first and second slots 350, 360. The combination of the rotation of the mounting member 330 and the translation of the mounting member 330 allows the center of gravity 390 to travel along the path P. The mounting member 330 may be rotated and translated simultaneously so that the center of gravity 390 remains positioned along the path P at all times. Alternatively, the mounting member 330 may be rotated and translated at different times. If the translation and rotation are not simultaneous, the center of gravity 390 may deviate slightly from the path P while the mounting member 330 is moved. In the extended position shown in FIG. 4B, the first and second projections 370, 380 are lockably received in the slots 354 and 364, respectively. As such, the orientation of the mounting member 330 is fixed, until the first and second projections 370, 380 are removed from the slots 354 and 364.

Figure 4C:
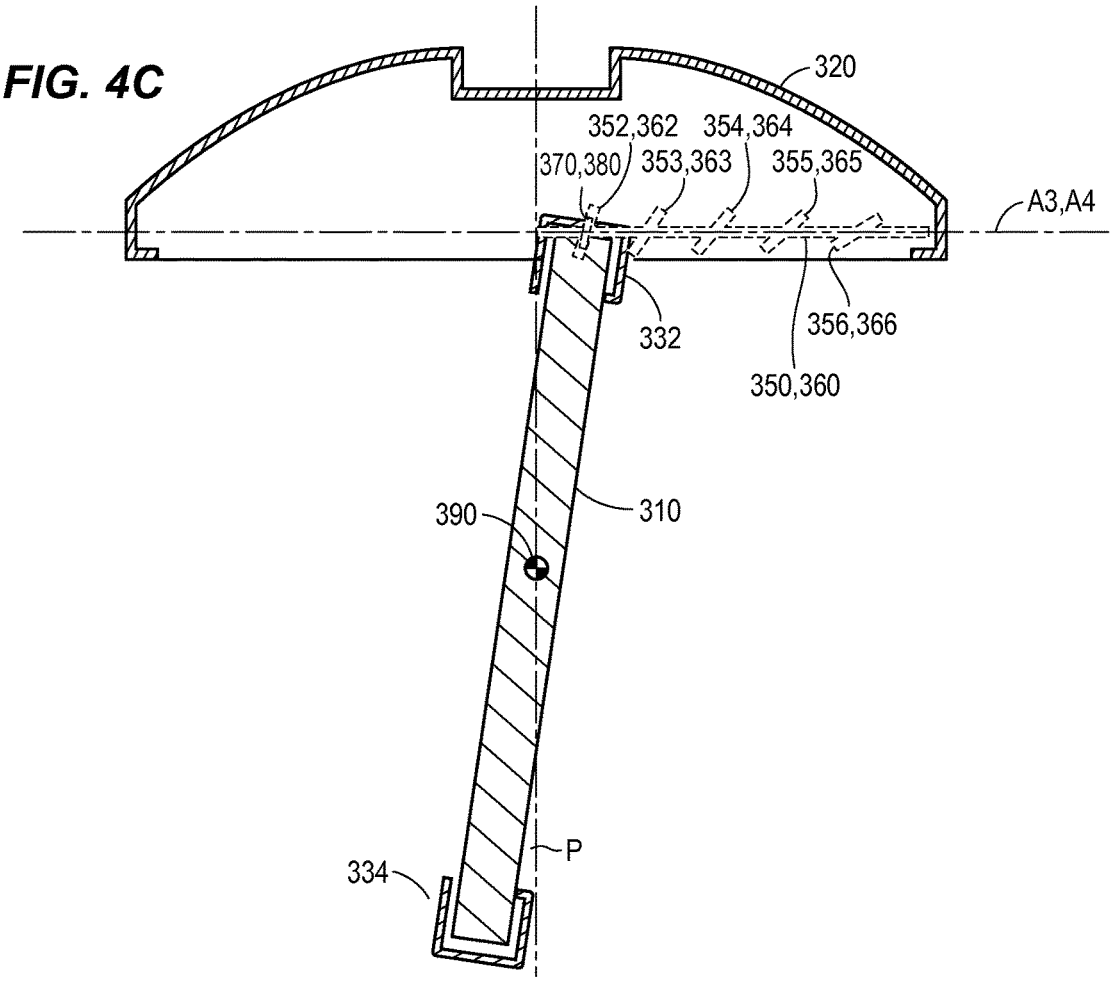
FIG. 4C shows a cross-sectional view of the adjustable light fixture in another extended position.

FIG. 4C illustrates the mounting member 330 in another extended position where the second end 334 of the mounting member 330 is swung further away from the base 320. Here, the first and second projections 370, 380 are lockably received in the slots 352 and 362, respectively. The center of gravity 390 remains positioned along the path P because the rotational axis A2 is moved further along the axes A3, A4.

The path P illustrated in FIGS. 4A-4C is linear and overlaps a centerline of the base 320. In other embodiments, the path P may be slightly curved and/or offset from the centerline of the base 320.

While the present embodiment of the light fixture 300 has been described with slots that extend along respective horizontal axes, in alternative embodiments, the slots may extend along respective curved paths and/or respective linear paths that are angled relative to the horizontal.

The light fixture 300 can be equipped with a motor (not shown) for moving the mounting member 330 between the retracted position and the various extended positions. The mounting member 330 can also be configured for manual adjustment by a user. The downwardly facing portion of the mounting member 330 may include a hole or depression that permits a user to insert a pole into the mounting member 330 and thereby change the orientation of the mounting member 330.

One benefit of configuring the mounting member 330 with a movable rotational axis A2 is that the mounting member 330 can rotate without the center of gravity 390 of the mounting member 330 substantially shifting to either side of the adjustable light fixture 300. This decreases the likelihood that the light fixture 300 becomes unbalanced or tilted when the mounting member 330 swings below the base 320. This can be advantageous when the adjustable light fixture 300 susceptible to tilting, such as when the adjustable light fixture 300 is suspended from a ceiling by cords.

Another benefit of the light fixture 300 is that the mounting member 330 does not extend above the upper plane of the light fixture 300 when the mounting member 330 is rotated. The mounting member 330 is therefore not likely to interfere with the ceiling positioned above the light fixture 300. Also, the light fixture 300 can be positioned in a recess in the ceiling (as described below in more detail) without concern that light clipping will result from a portion of the light source 310 being positioned above the ceiling when the mounting member 330 is rotated.

Figure 5A:
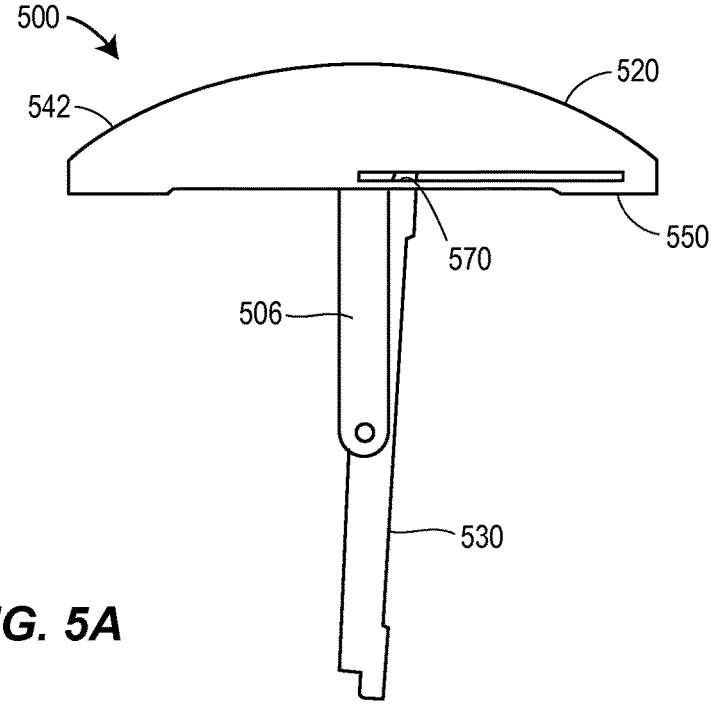
FIG. 5A depicts a plan view of an adjustable light fixture constructed in accordance with principles of a second example of the present disclosure.
Figure 5B:
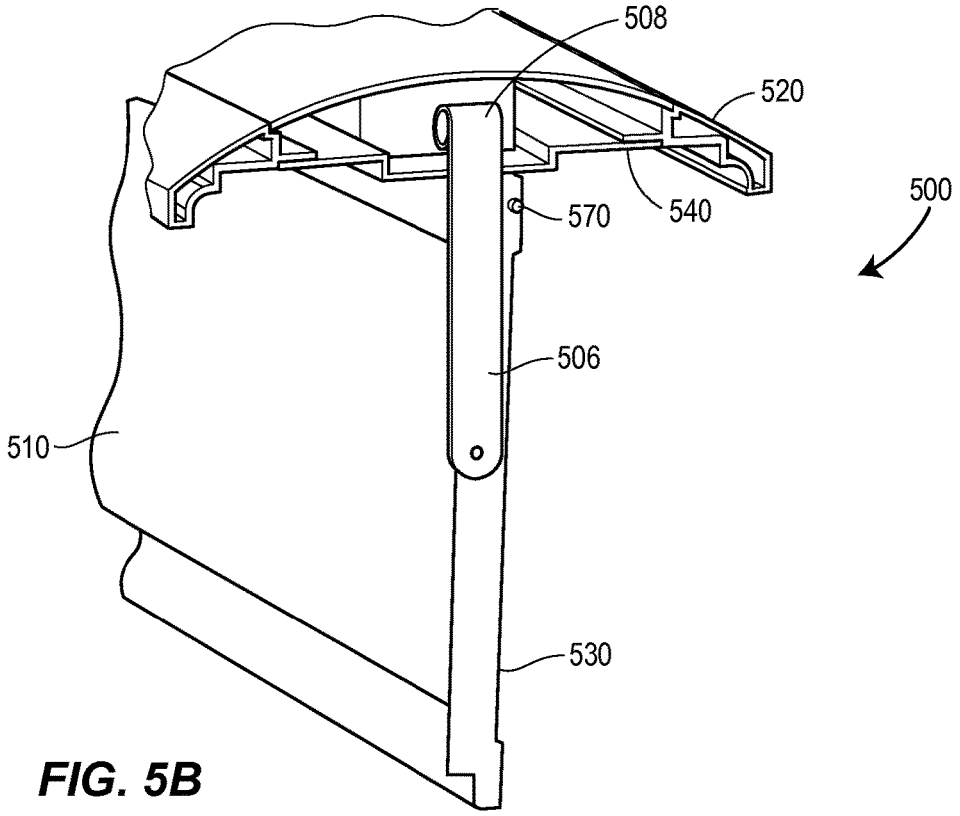
FIG. 5B illustrates a perspective view of the adjustable light fixture shown in FIG. 5A with an end plate removed.

In some embodiments, the adjustable light fixture may include a mechanism that helps guide the center of gravity of the mounting member along a path orthogonal or substantially orthogonal to the base member. FIGS. 5A and 5B illustrate an adjustable light fixture 500 having a spring member 506 for this purpose. The adjustable light fixture 500 includes a light source 510, a base 520 and mounting member 530 that movably connects the light source 510 to the base 520. The base 520 includes a cavity 540 bounded on opposite sides by first and second end plates in a manner similar to the above-described embodiment. A first slot 550 is formed in the first end plate 542, and a second slot (not shown) is formed in the second end plate (not shown). The mounting member 530 includes a first projection 570 slidably disposed in the first slot 550, and a second projection (not shown) slidably disposed in the second slot (not shown). While an interior surface 551 of the first slot 550 is depicted as being smooth surface in FIG. 5A, in some embodiments, the interior surface 551 can include a plurality of grooves for locking the mounting member 530 in a plurality of different positions similar to the first slot 350 described above. The same applies to the second slot (not shown).

One end of the spring member 506 is rotatably attached to the mounting member 530 at, or close to, the center of gravity of the mounting member 530. The other end of the spring member 506 is attached to the base 520. The spring member 506 provides a linear force that urges the center of gravity of the mounting member 530 along a path orthogonal or substantially orthogonal to the base 520. The spring member 506 illustrated in FIGS. 5A and 5B is a constant force spring. The spring member 506 is configured to roll up into a rolled portion 508 positioned inside the base 530 as shown in FIG. 5B. When the spring member 506 is unrolled, the rolled portion 508 exerts a restoring force that pulls the unrolled portion back toward the base 520. The spring member 506 therefore pulls the mounting member 530 in the upward vertical direction. This force helps guide the center of gravity of the mounting member 530 along a path orthogonal or substantially orthogonal to the base 520. This path may overlap the centerline of the base 520. When the mounting member 530 is arranged in the retracted position (i.e., where both ends of the mounting member 530 are housed or partially housed within the cavity 540), the majority of the spring 506 may be retracted into the rolled portion 508 so that the entire spring member 506 is positioned inside base 520. In some embodiments, the spring member 506 may be a conical spring that provides a linear force pushing the mounting member 530 away from the base 520.

Figure 6A:
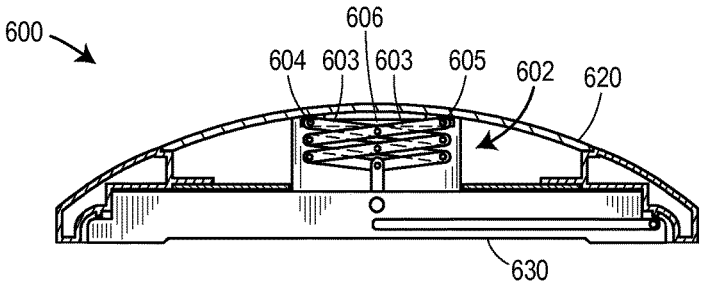
FIG. 6A shows an adjustable light fixture constructed in accordance with principles of a third example of the present disclosure, with the adjustable light fixture arranged in a retracted position.
Figure 6B:
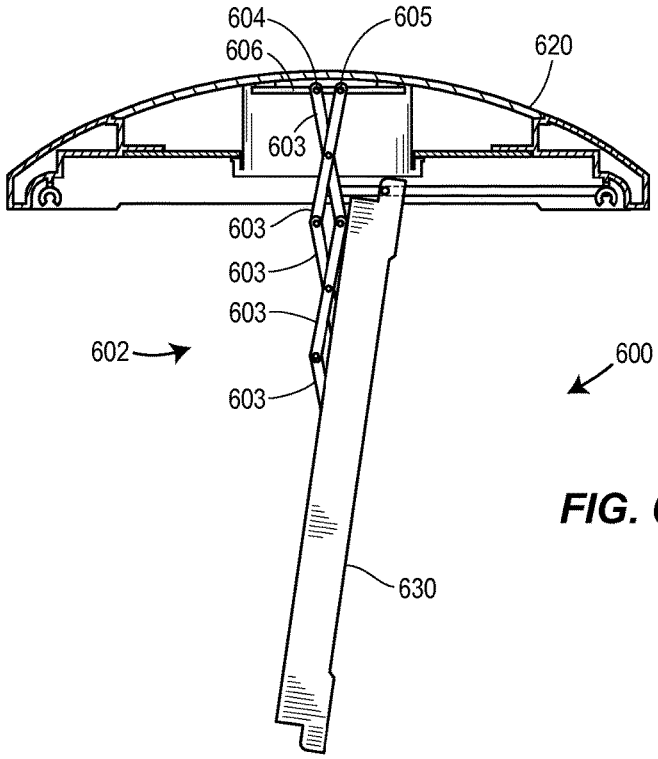
FIG. 6B depicts the adjustable light fixture of FIG. 6A arranged in an extended position.

FIGS. 6A and 6B illustrate an embodiment of the adjustable light fixture that employs a scissors mechanism to help guide the center of gravity of a mounting member along a path orthogonal or substantially orthogonal to the base. FIGS. 6A and 6B show an adjustable light fixture 600 including a base 620 and a mounting member 630 that movably connects a light source to the base 620. Similar to the above-described embodiments, the base 620 includes two end plates bounding a cavity. The end plates may include slots, and the mounting member 630 may include projections slidably disposed in the slots similar to the embodiments described above. Different from the above-described embodiments, the adjustable light fixture 600 includes a scissors mechanism 602 having a plurality of folding links 603 arranged in a crisscross pattern. One end of the scissors mechanism 602 is rotatably attached to the mounting member 630 at, or close to, the center of gravity of the mounting member 630. The other end of the scissors mechanism 602 is slidably attached to the base 620. The base 620 may include a slot 606 that slidably receives pins or projections 604, 605 protruding from the folding links 603 at the upper end of the scissors mechanism 602.

Figure 6C:
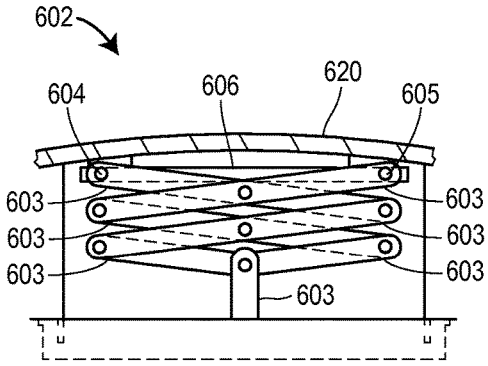
FIG. 6C is an enlarged view of a link mechanism of the adjustable light fixture shown in FIG. 6A.
Figure 6D:
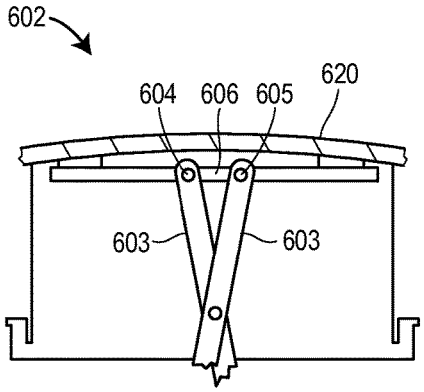
FIG. 6D is an enlarged view of a link mechanism of the adjustable light fixture depicted in FIG. 6B.

FIG. 6A illustrates the mounting member 630 in a retracted position. Here, the scissors mechanism 602 is collapsed so that the folding links 603 are folded into a compact arrangement. FIG. 6C shows an enlarged view of this arrangement of the scissors mechanism 602. When the mounting member 630 is moved to the extended position depicted in FIG. 6B, the scissors mechanism 602 unfolds and guides the center of gravity of the mounting member 630 along a path orthogonal or substantially orthogonal to the base 620. This path may overlap the centerline of the base 620. FIG. 6D depicts the upper end of the scissors mechanism 602 in the unfolded configuration. Springs (not shown) may be provided to bias the projections 604, 605 towards the ends of the slot 606 as shown in FIG. 6C, or to bias the projections 604, 605 towards the center of the slot 606 as shown in FIG. 6D.

Figure 7A:
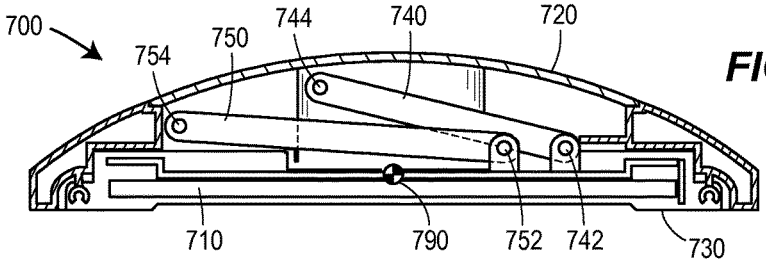
FIG. 7A shows an adjustable light fixture constructed in accordance with principles of a fourth example of the present disclosure, with the adjustable light fixture arranged in a retracted position.
Figure 7B:
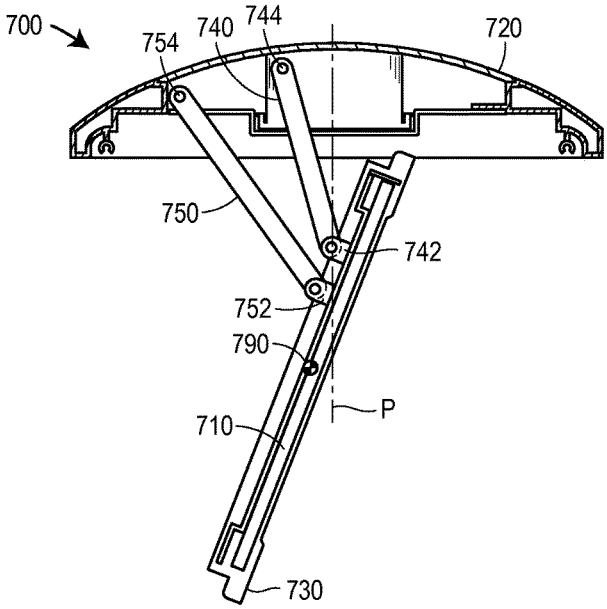
FIG. 7B illustrates the adjustable light fixture of FIG. 7A arranged in an extended position.
Figure 7C:
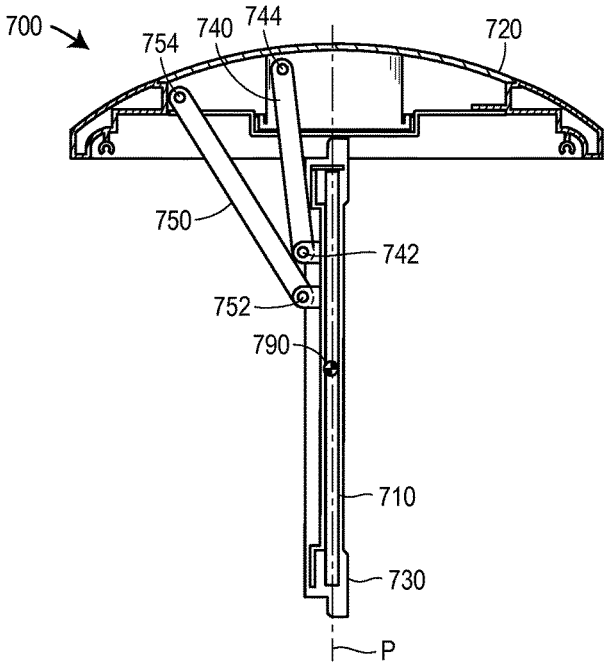
FIG. 7C illustrates the adjustable light fixture of FIG. 7A arranged in another extended position.

Guiding the center of gravity of the mounting member along a path orthogonal or substantially orthogonal to the base can also be implemented by a four-bar linkage. FIGS. 7A-7C depict an adjustable light fixture 700 including a light source 710, a base 720 and a mounting member 730 that movably connects the light source 710 to the base 720. The mounting member 730 is connected to the base 720 by a first link 740 and a second link 750. The first link 740 includes a first end 742 rotatably attached to the mounting member 730, and a second end 744 rotatably attached to the base 720. The second link 750 includes a first end 752 rotatably attached to the mounting member 730, and a second end 754 rotatably attached to the base 720. The first link 740 may be shorter than the second link 750. The second end 744 of the first link 740 may be closer to the center of the base 720 than the second end 754 of the second link 750. The first end 752 of the second link 750 may be closer to the center of the mounting member 730 than the first end 742 of the first link 744. The linear distance separating the first end 742 of the first link 740 and the first end 752 of the second link 750 may be less than the linear distance separating the second end 744 of the first link 740 and the second end 754 of the second link 750.

The base 720, the mounting member 730, the first link 740 and the second link 750 together form a four-bar linkage. FIGS. 7A-7C illustrate the movement of the mounting member 730 from the retracted position to a fully extended position. The first and second links 740, 750 cause a first end 732 of the mounting member 730 to translate toward the center of the base 720. The translation of the first end 732 may be linear or substantially linear. At the same time, the mounting member 730 rotates such that a second end 734 of the mounting member 730 swings below that base 720. The center of gravity 790 of the mounting member 730 travels along a path P that is orthogonal or substantially orthogonal to the base 720. In one embodiment, the center of gravity 790 deviates at most from the path P by 0.06 inches. The path P may overlap the centerline of the base 720. The four-bar linkage of the embodiment illustrated in FIGS. 7A-7C makes it unnecessary to configure the end plates of the base with slots for slidably receiving projections from the mounting member. This may help reduce manufacturing costs.

While the invention has been described in connection with various embodiments, the invention is capable of further modifications. The details of the structure and method may be varied substantially without departing from the spirit of the invention. The exclusive use of all modifications which come within the scope of the appended claims is reserved.

What is claimed is:

1. An adjustable light fixture comprising:

a base including a cavity bounded on opposite sides by a first end plate and a second end plate;

a first slot extending through the first end plate, and a second slot extending through the second end plate; and a mounting member including a first projection slidably disposed in the first slot and a second projection slidably disposed in the second slot;

a light source fixed relative to the mounting member; and the mounting member and the light source being rotatable about a similar rotational axis, wherein the rotational axis moves relative to the base when the first and second projections slide along their respective first and second slots, and wherein the rotational axis is defined by and passes through the first and second projections.

2. The adjustable light fixture of claim 1, wherein a center of gravity of the mounting member is configured to move along a path substantially orthogonal to a longitudinal axis of the base by virtue of rotation of the mounting member and translation of the mounting member along the first and second slots.

3. The adjustable light fixture of claim 1, wherein the first slot includes a surface formed with a plurality of grooves configured to receive the first projection so that that the mounting member is lockable in a plurality of positions along a length of the first slot.

4. The adjustable light fixture of claim 1, comprising a spring member connected to the base and rotatably connected to the mounting member to guide a central portion of the mounting member along a path substantially orthogonal to a longitudinal axis of the base.

5. The adjustable light fixture of claim 1, comprising the light source, wherein the light source is a light emitting diode (LED) panel.

6. The adjustable light fixture of claim 1, wherein the mounting member includes oppositely disposed first and second ends, the first end being movably connected to the base by way of the first and second projections;

the mounting member being movable between: (i) a retracted position where each of the first and second ends of the mounting member is at least partially housed within the cavity, and (ii) an extended position where the second end is exterior to the cavity.

7. The adjustable light fixture of claim 6, wherein the light source directs light in a downward direction when the mounting member is arranged in the retracted position, and the light source directs light in a direction angled relative to the downward direction when the mounting member is arranged in the extended position.

8. An overhead adjustable light fixture comprising:

a base connectable to an overhead static structure such that the base is positionable below the overhead static structure in a vertical direction;

a slot formed in the base;

a light source operatively connected to the base such that the light source is rotatable about a rotational axis and the rotational axis is movable relative to the base in a direction non-parallel to the vertical direction; and a mounting member operatively connecting the light source to the base, the mounting member including a projection slidably disposed in the slot, wherein the rotational axis passes through and is defined by the projection.

9. The overhead adjustable light fixture of claim 8, wherein a center of gravity of the mounting member is configured to move along a path substantially orthogonal to a longitudinal axis of the base by virtue of rotation of the mounting member and movement of the rotational axis relative to the base.

10. The overhead adjustable light fixture of claim 9, wherein a surface surrounding the slot possesses a plurality of grooves configured to receive the projection so that the mounting member is lockable in a plurality of positions along a length of the slot.

11. The overhead adjustable light fixture of claim 8, wherein the light source is configured to rotate about the rotational axis while the rotational axis moves relative to the base so that the light source simultaneously rotates and translates.

12. The overhead adjustable light fixture of claim 8, comprising the light source, wherein the light source is a light emitting diode (LED) panel.

13. The overhead adjustable light fixture of claim 8, comprising a first link rotatably connected to the base and rotatably connected to the light source, and a second link rotatably connected to the base and rotatably connected to the light source, such that a four-bar linkage is formed by the base, the first link, the second link and the light source.

14. The overhead adjustable light fixture of claim 9, the base including a cavity that opens downwardly away from the overhead static structure, the mounting member including oppositely disposed first and second ends, and the mounting member being movable between: (i) a retracted position where each of the first and second ends of the mounting member is at least partially housed within the cavity, and (ii) an extended position where at least one of the first and second ends of the mounting member swings below the cavity.

15. A method comprising:

providing an overhead light fixture comprising a base attached below an overhead structure in a vertical direction and a light source operatively connected to the base by a mounting member, the mounting member including a first projection slidably disposed in a first slot formed in the base;

rotating the light source about a rotational axis passing through and defined by the first projection; and translating the light source relative to the base so that the rotational axis of the light source moves in a non-parallel direction relative to the vertical direction.

16. The method of claim 15, wherein the rotation of the light source and the translation of the light source is performed simultaneously.

17. The method of claim 15, wherein the base includes a cavity bounded on opposite sides by a first end plate and a second end plate, and the first slot extends through the first end plate.

18. The method of claim 15, further comprising translating a center of gravity of the light source along a path substantially orthogonal to a longitudinal axis of the base.

19. The adjustable light fixture of claim 1, wherein movement of a center of gravity of the mounting member is confined to a linear vertical path substantially orthogonal to a longitudinal axis of the base during rotation and translation of the mounting member relative to the base.

20. The adjustable light fixture of claim 19, comprising at least one cord connected to the base and configured to suspend the base from an overhead structure.

* * * * *